US005154327A

United States Patent [19]

Long

[11] Patent Number: 5,154,327

[45] Date of Patent: Oct. 13, 1992

[54] SEALABLE NOZZLE ADAPTOR FOR USE WITH A CAULKING TUBE CARTRIDGE

[76] Inventor: Kyle D. Long, 1918 E. I St., Torrington, Wyo. 82240

[21] Appl. No.: 677,782

[22] Filed: Mar. 29, 1991

Related U.S. Application Data

[63] Continuation-in-part of Ser. No. 505,066, Apr. 5, 1990, abandoned.

[51] Int. Cl.[5] ..... B67D 3/00

[52] U.S. Cl. ..... 222/326; 220/375; 220/379; 222/151; 222/543; 222/546; 222/567

[58] Field of Search ..... 222/151, 546, 149, 326, 222/327, 566, 567, 570, 543; 215/250, 304, 306; 220/375, 379

[56] References Cited

U.S. PATENT DOCUMENTS

| | | | |
|---|---|---|---|
| 152,980 | 7/1884 | Donkin | 222/546 X |
| 193,760 | 7/1877 | Hauck | 222/151 |
| 771,984 | 10/1934 | Desle et al. | 222/151 |
| 1,137,086 | 4/1915 | Rodiger | 222/546 |
| 1,991,523 | 2/1935 | Robinson | 222/151 |
| 2,677,482 | 5/1954 | Lehmann | 222/546 X |
| 2,754,033 | 7/1956 | Etter | 222/326 |
| 2,849,739 | 9/1958 | Dresden | 222/92 X |
| 2,887,240 | 5/1959 | Deussen | 215/250 |
| 3,164,240 | 1/1965 | Trautmann | 222/546 X |
| 3,192,555 | 7/1965 | Nyden | 222/192 X |
| 3,193,146 | 7/1965 | Isgriggs et al. | 222/326 X |
| 3,282,478 | 11/1966 | Russell | 222/546 X |
| 4,150,768 | 4/1979 | Maynard, Jr. | 222/570 X |
| 4,213,546 | 7/1980 | Massey | 222/546 |
| 4,345,704 | 8/1982 | Boughton | 222/543 X |
| 4,635,823 | 1/1987 | Stull | 222/543 |
| 5,004,128 | 4/1991 | Richichi | 222/527 |
| 5,029,738 | 7/1991 | Dillon | 222/527 |
| 5,065,913 | 11/1991 | Glasener | 222/527 X |

FOREIGN PATENT DOCUMENTS

| | | | |
|---|---|---|---|
| 1238023 | 6/1988 | Canada | 222/570 |

*Primary Examiner*—Kevin P. Shaver
*Attorney, Agent, or Firm*—Dean P. Edmundson

[57] ABSTRACT

A sealable nozzle adaptor is described for use on a caulking tube. The adaptor incudes a nozzle portion, a base including a flexible skirt portion for engaging the leading end of the caulking tube, a cap for closing and sealing the open end of the nozzle, and an elongated pin secured in the cap and extending into the nozzle portion. The cap can be attached to the base with a flexible strip or cord to prevent loss. The adaptor slides over the leading end of the caulking tube and prevents air from leaking into the caulking tube.

16 Claims, 6 Drawing Sheets

SEALABLE NOZZLE ADAPTOR FOR USE WITH A CAULKING TUBE CARTRIDGE

CROSS-REFERENCE TO RELATED APPLICATION

This is a continuation-in-part of my copending application Ser. No. 07/505,066, filed Apr. 5, 1990, now abandoned.

FIELD OF THE INVENTION

This invention relates to caulking tube dispensing nozzles. More particularly, this invention relates to techniques and systems for sealing opened dispensing nozzles of caulking tubes and the like.

BACKGROUND OF THE INVENTION

Caulking tubes (e.g., polyurethane or cardboard tube containers) are widely used for packaging of various materials such as sealants, adhesives, and other caulking compositions. These materials are normally paste or gel materials which harden when exposed to the environment.

Such tubes include a tapered dispensing nozzle at their leading end. The nozzle can be cut off at a desired location to enable the contents of the tube to be dispensed by a caulking gun which advances a plunger or disk through the tube.

Oftentimes the entire contents of a caulking tube are not used at one time or on one jobsite. As a result, the composition in the tube will begin to dry out or cure. The longer the opened tube is stored before it is used again, the more of the composition that will undesirably cure. Because the compositions sold in caulking tubes are often very expensive, it can be quite costly when the composition cures in the tube and is therefore wasted.

Sometimes it is possible to dig out cured composition from the open end of the nozzle of the tube if the tube hasn't been stored too long after being opened. However, often it is not possible to do this because the composition has cured too deep. Sometimes it is possible to cut an additional length off the nozzle to allow access to uncured composition in the tube, but this procedure leaves too large an opening in the nozzle for useful dispensing of the composition.

Although it has been proposed to put a cap member over the open end of a caulking tube nozzle, this has not been entirely successful because some air remains in the nozzle or leaks past the cap. Thus, the composition can still become cured or hardened during storage, at least at the outer end of the nozzle.

A tapered dispensing tip has also been proposed for fitting over a caulking tube nozzle. However, the tip does not seal the end of the nozzle after the composition has been dispensed from the tube.

Although various types of spouts, caps and nozzles have been used on cans, tubes and bottles, none of such devices are suitable or practical for use on caulking tubes in a manner such that (1) the composition in the tube can be easily and readily dispensed, (2) the tube can be effectively sealed to prevent the composition in the tube and nozzle from hardening prematurely during shortage, and (3) the nozzle can be re-used on a variety of caulking tubes without modification and without loss of effectiveness.

There has not heretofore been proposed a technique or system for sealing the open nozzle of a caulking tube having the advantages provided by the present invention.

SUMMARY OF THE PRESENT INVENTION

In accordance with the present invention there is provided a sealable nozzle adaptor for use on a conventional caulking tube of the type including a tapered dispensing nozzle at the leading end of the tube, wherein the leading end includes a generally planar end face which is perpendicular to the longitudinal axis of the tube. The adaptor comprises:

(a) an elongated flexible nozzle portion having forward and rearward ends, wherein the forward end has a smaller diameter than the rearward end; and the nozzle portion has a longitudinal passageway therethrough;

(b) a base member integral with the rearward end of the nozzle portion; wherein the base member includes a generally planar portion which is perpendicular to the longitudinal centerline of the nozzle portion; and wherein the base member further includes a flexible skirt portion which extends rearwardly away from the planar portion for surrounding and frictionally engaging the leading end of the caulking tube without any need for threaded engagement;

(c) a cap member detachably attached to said forward end of said nozzle portion; said cap member including a first closed end and a second open end; said cap member including a cavity therein; and (d) an elongated pin member having first and second ends, wherein said first end is secured to said first end of said cap member; wherein said pin member extends through said cavity and beyond said open end of said cap.

The nozzle adaptor is capable of sealing the nozzle of any conventional caulking tube to prevent air from entering the nozzle during storage. No threaded connection or mechanical lock between the adaptor and the caulking tube is required.

In a preferred embodiment the pin member is sufficiently long to extend into the upper or leading end of the caulking tube. The pin member forces air out of the nozzle so that the composition in the nozzle and the tube does not cure or harden during storage. It also prevents the tip of the nozzle from becoming plugged with hardened composition.

Another advantage of the nozzle adaptor of the invention is that the cap member can be attached to a strap or cord and fastened to the adaptor so that it cannot be lost or misplaced.

Another advantage of the nozzle adaptor is that it can be used on caulking tubes which have worn out or damaged nozzles. For example, the old nozzle on the tube can be cut off (entirely or partially) and then the nozzle adaptor of this invention can be fitted onto the caulking tube for easy dispensing of the contents of the tube. The nozzle adaptor can also be used as a cap member on caulking tubes, if desired.

Other advantages of the sealable nozzle adaptor will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
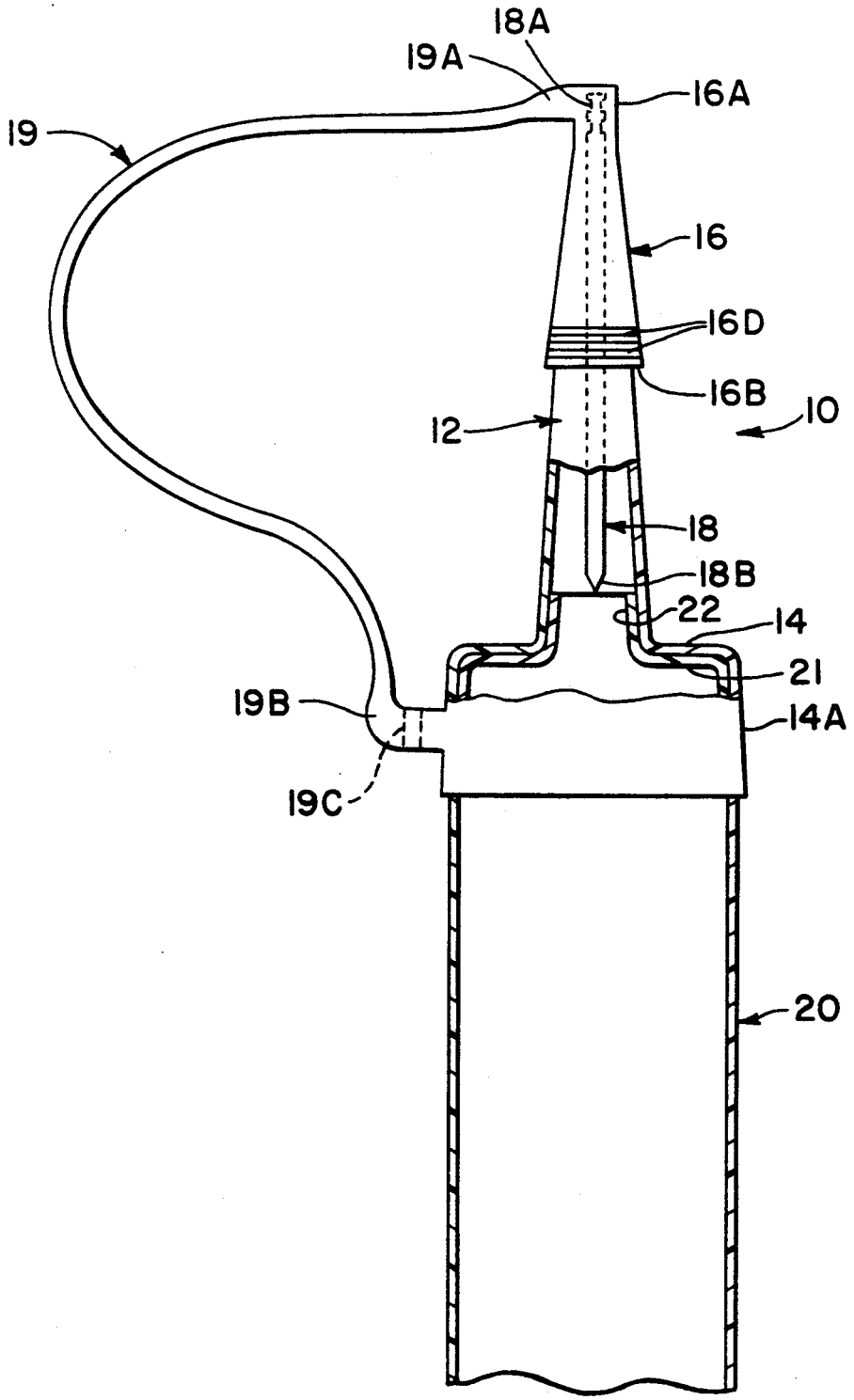
FIG. 1 is a side elevational view (partially cut-away) of a sealable nozzle adaptor of the invention affixed to the nozzle end of a conventional caulking tube.
Figure 2:
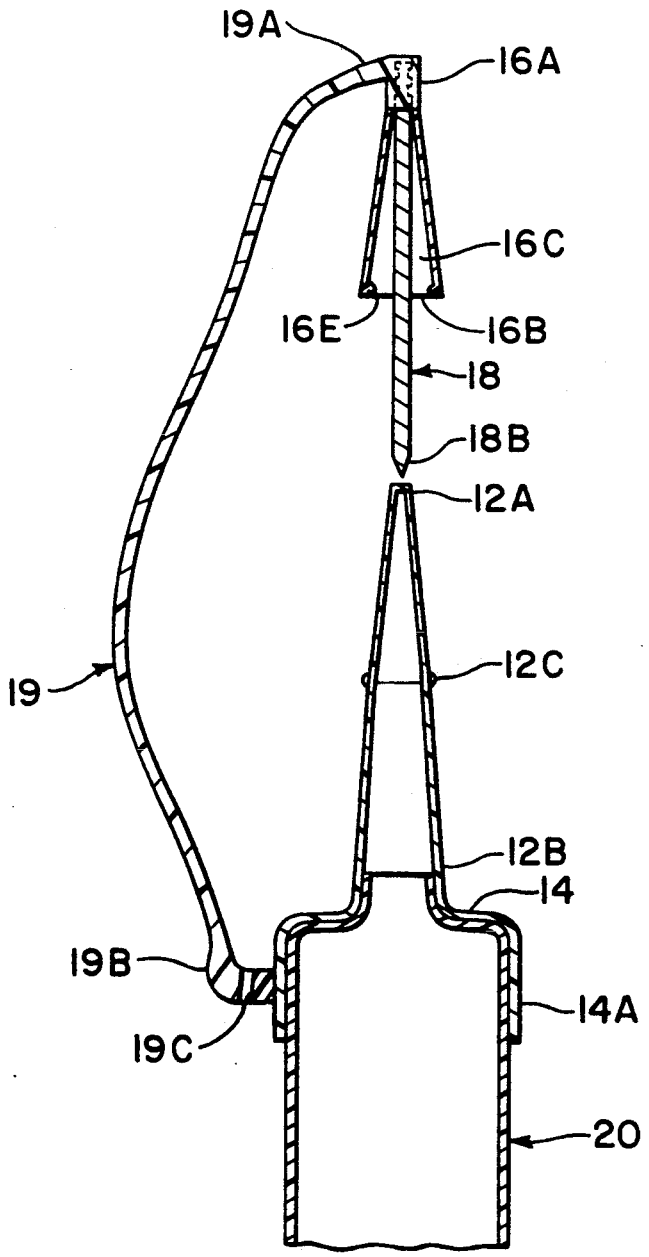
FIG. 2 is a cross-sectional view illustrating one embodiment of the adaptor with the cap removed.

There is illustrated a preferred embodiment of sealable nozzle adaptor 10 of the invention for use on a conventional caulking tube 20 of the type including a tapered dispensing nozzle 22 and a generally planar end face 21 at the leading end of the tube. The end face 21 is perpendicular to the longitudinal axis of the tube.

The nozzle adaptor of the invention includes an elongated flexible nozzle portion 12 having forward end 12A and rearward end 12B. The adaptor is tapered from rearward to forward ends as illustrated, and a longitudinal passageway extends through the adaptor.

A base member 14 is integral with the rearward end of the nozzle portion and it includes a generally planar portion which is perpendicular to the longitudinal centerline of the nozzle portion. As illustrated in the drawings, the base member preferably includes an annular collar or skirt portion 14A which extends around the periphery of the leading end of the caulking tube and downwardly along the sides of the tube (i.e., rearwardly away from the planar portion 14). The collar or skirt portion may be tapered outwardly slightly (e.g., a few thousandths of an inch) from the leading end to the rearward end, if desired, so that the collar will fit tightly over the end of the caulking tube regardless of minor irregularities or styling differences in the caulking tube. Thus, the sliding frictional engagement of the collar or skirt portion with the end of the caulking tube will increase as the collar or skirt portion is urged further onto the end of the tube. No threads or similar attachment mechanism is required.

The base member retains the adaptor on the caulking tube and also prevents air from entering into the adaptor from its lower or rearward end. The interior surface of the annular collar or skirt portion may optionally include one or more annular ribs or ridges to assist in facilitating a seal between the skirt portion and the end of the tube so as to prevent air from leaking into the adaptor.

As shown in the drawings, the planar portion of the base 14 rests or fits closely against the planar end face 21 of the caulking tube. The skirt portion 14A also fits tightly against the outer edge or periphery of the caulking tube. As a result, air is prevented from leaking into the nozzle or the tube itself. Also, because there is no gap (or essentially no gap) between the planar portion of base member 14 and the planar end face 21 of the caulking tube, essentially no composition from the tube is able to leak out between the nozzle portion 22 and the base portion 14.

Preferably the skirt portion 14A extends rearwardly away from the planar portion of base 14 by a distance of at least 0.75 inch (and it may extend a distance up to about 1.5 inches or more). The skirt portion 14A is flexible and resilient and it is capable of providing a tight frictional engagement with the periphery of the tube. This feature keeps air from leaking in and it keeps composition from leaking out of the tube past the base.

A cap member 16 is detachably attached to the forward end of the nozzle portion. The cap member includes a closed end 16A and an open end 16B. The cap member also includes a cavity 16C therein for receiving the forward end of the nozzle portion when the nozzle adaptor is to be sealed.

If desired, the cap member may include raised ribs 16D on its outer surface to facilitate gripping by hand to remove the cap from the nozzle. Also, a rib 16E may be included on the inner surface of the cap to facilitate engagement with a raised rib 12C on nozzle portion 12.

Figure 3:
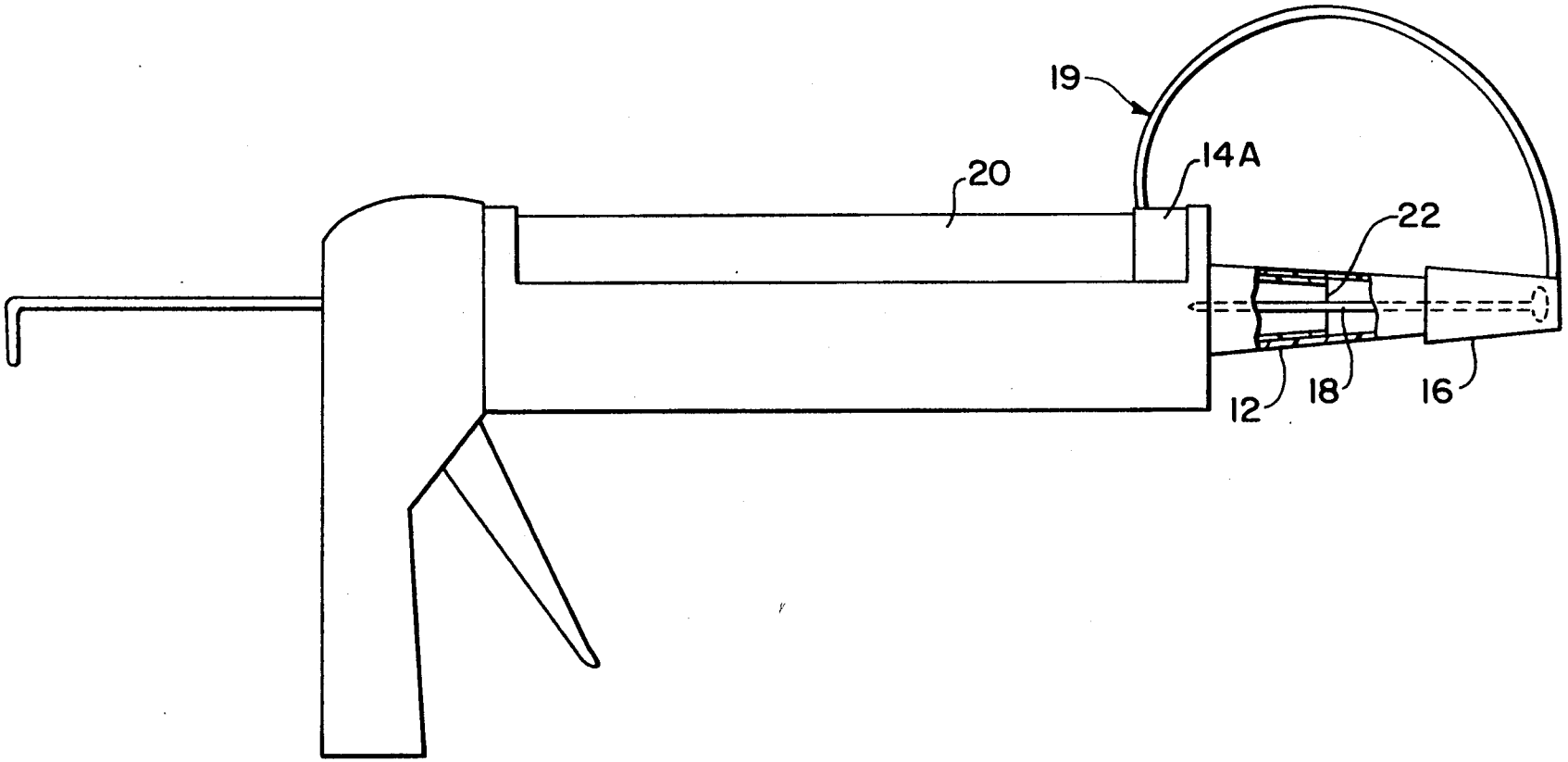
FIG. 3 illustrates a conventional caulking gun in which a caulking tube has been inserted; the nozzle end of the tube has been sealed with an adaptor of the invention.

An elongated pin member 18 is secured in and carried by the cap member. As illustrated in the drawings, the upper or forward end 18A of the pin is secured within the upper or forward end 16A of the cap. The pin extends downwardly through the cavity 16C in the cap, and the lower end 18B of the pin member extends past the open end of the cap. If desired, the lower end of the pin 18 may be adapted to extend all the way through the dispensing nozzle on the caulking tube and into the leading end of the caulking tube (as illustrated in FIG. 3).

The combination of the base portion of the nozzle adaptor, the cap member, and the pin member operates to seal the nozzle on the caulking tube and prevent air from entering the nozzle or the tube. Thus, the nozzle adaptor of the invention is effective for sealing the opened dispensing nozzle on the caulking tube.

Consequently, the nozzle adaptor allows a portion of the contents of a caulking tube to be used, after which the tube can be easily sealed again until an additional quantity of the contents of the tube is required to be used. This nozzle adaptor is very useful and effective and allows the unused contents of a caulking tube to be saved until it is needed. It does not cure in the nozzle or in the tube itself.

The nozzle adaptor of this invention can also be used as a stem replacement on a caulking tube. It is also possible to use the nozzle adaptor as a cover or cap on the end of an open tube (e.g., on a caulking tube whose end has been cut off for one reason or another).

The cap member can be retained on an elongated flexible strap or cord 19 which is secured at one end 19A to the cap and at the opposite end 19B to the base portion. The strap is preferably made of plastic or rubber and may be integrally molded with the cap and base portion. The length of the strap is sufficient to enable the pin member to be easily inserted into and removed from the open upper end of the nozzle portion of the adaptor. The strap keeps the cap member from being lost or misplaced.

The pin member preferably has a diameter in the range of about 0.05 to 0.15 inch when the adaptor is intended for use on conventional caulking tubes. Generally the opening in the upper or leading end 12A of the nozzle adaptor is slightly smaller than the diameter of the pin member. Preferably the diameter of the pin member at the upper end thereof is slightly larger than the diameter of the open upper end 12A of the nozzle portion so that the upper end of the pin fits tightly and prevents air from entering the nozzle. If desired, the outer surface of the upper end of the nozzle portion may include ribs 12C to facilitate a tight frictional engagement of the cap to the nozzle portion of the adaptor as previously explained. This also helps to keep air out of the nozzle and the caulking tube.

The nozzle adaptor may be made in any desired size. It may even be made sufficiently large to be able to be fitted onto the end of a so-called quart-size caulking tube (e.g., of the type used for construction adhesive). For such uses, the pin member may have a diameter at its upper end as large as about 0.4 inch.

The pin member is preferably made of metal or other rigid material. It may also be made of plastic, if desired. The length of the pin member may vary. Preferably it is long enough to extend through the cavity of the cap member and into the lower end of the nozzle portion. Even more particularly, the pin member is long enough to extend into the leading end of the caulking cartridge. The pin member may be tapered from its upper end to its lower end, if desired.

The pin member also has utility as a tool to remove any composition which may have cured in the nozzle in the unlikely event that this may have happened.

The nozzle adaptor of the invention can also be used on caulking tubes which have worn out or damaged nozzles. For example, the outer end of the nozzle on the tube may be cut off (as shown for example in the cutaway view of FIGS. 1 and 3), after which the nozzle adaptor of this invention can be fitted onto the end of the caulking tube. The remaining portion of the original nozzle 22 on the tube fits inside the nozzle adaptor, as shown.

Figure 4:
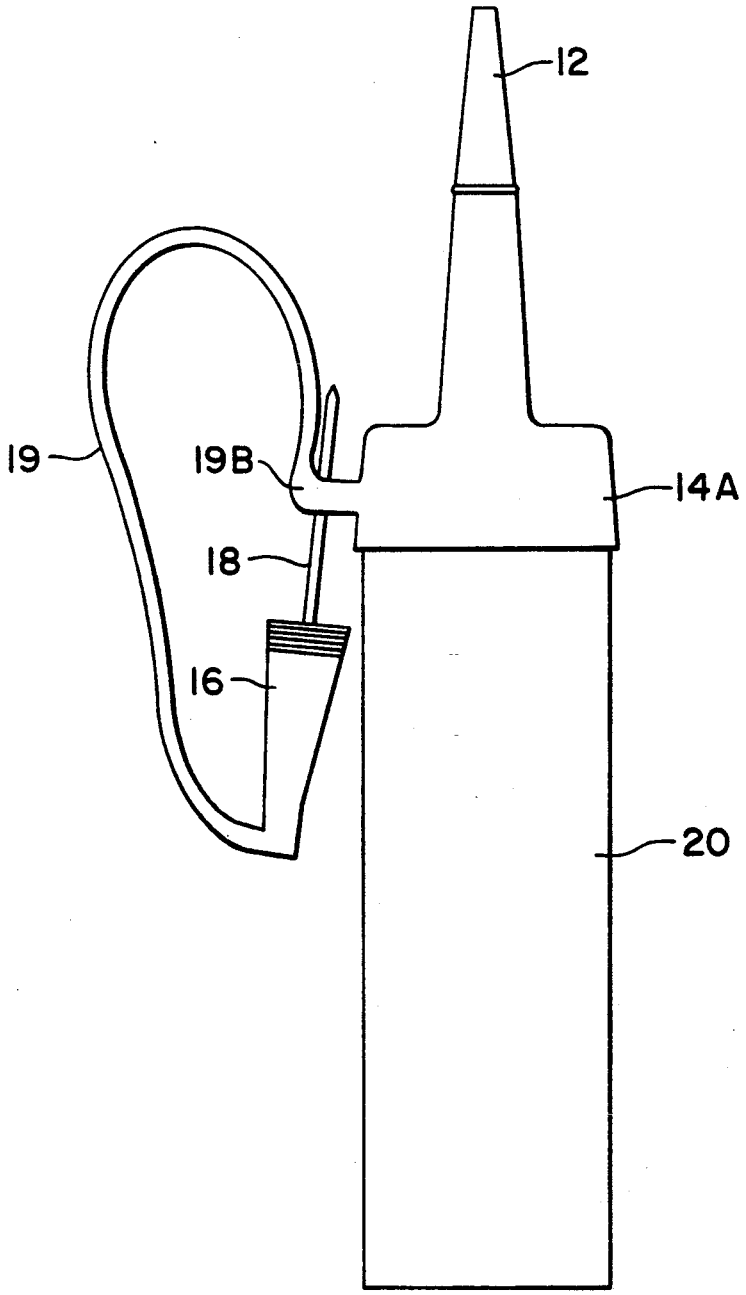
FIG. 4 is a side elevational view illustrating use of the nozzle adaptor of the invention as a sealing cap on a caulking tube.
Figure 5:
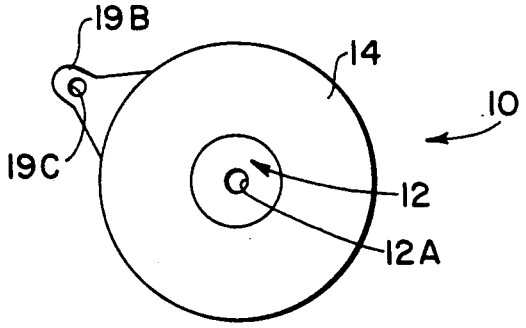
FIG. 5 is a top view of one embodiment of the nozzle adaptor of the invention.

FIGS. 4 and 5 illustrate another feature of the preferred nozzle adaptor of the invention. The lower end of strap 19 attaches to skirt portion 14A by means of an enlarged section 19B which may be referred to as a lever. If desired, the lower end of the strap may be integral with the lever (i.e., they may be composed of the same material, although the lever portion is thicker and more rigid than the strap portion). The lever portion includes a small aperture 19C through it near the skirt portion 14A. The pin member 18 may be positioned through the aperture 19C from either the top or bottom, as illustrated, to help retain the cap when it is not in place on the outer end of the nozzle portion.

Figure 6:
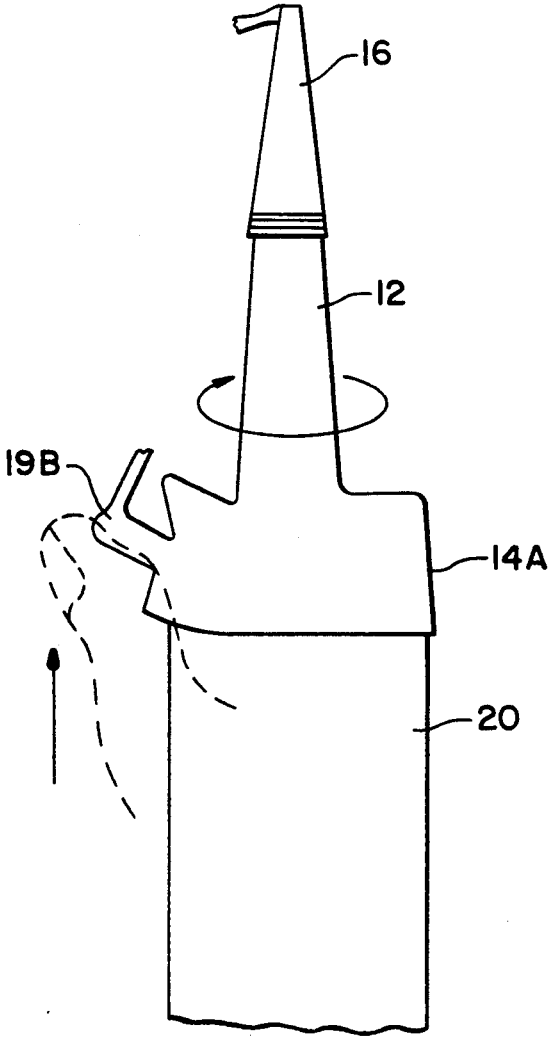
FIG. 6 is a side elevational view showing a caulking tube with sealable nozzle adaptor on the nozzle end and showing a preferred manner for removing the adaptor.

FIG. 6 illustrates another feature of the nozzle adaptor of the invention. The skirt portion 14A tightly engages the periphery of the tube 20. To facilitate removal of the nozzle adaptor from the tube, the lever 19B may be urged forwardly in the direction of the arrow with a thumb. This causes the flexible skirt 14A to be deformed adjacent the lever to enable air to move between the skirt portion and the tube. In other words, this action averts a vacuum between the base portion of the adaptor and the end of the tube when the adaptor is removed. After the lever 19B has been urged forwardly as illustrated, the nozzle adaptor may be rotated in the direction indicated to assist in removing it from the tube 20.

The length of the lever 19B is at least about 0.5 inch and may be greater (e.g., about 0.75 inch or more). Preferably the lever projects outwardly from the skirt portion 14A at a right angle, as illustrated. Preferably the lever is about 0.5 to 0.75 inch rearwardly from the planar portion of the base 14. The thickness of the lever portion is about 0.25 to 0.4 inch so that it has sufficient strength and rigidity to function as a lever in deflecting the skirt portion and urging the nozzle adaptor off the tube.

Figure 7A:
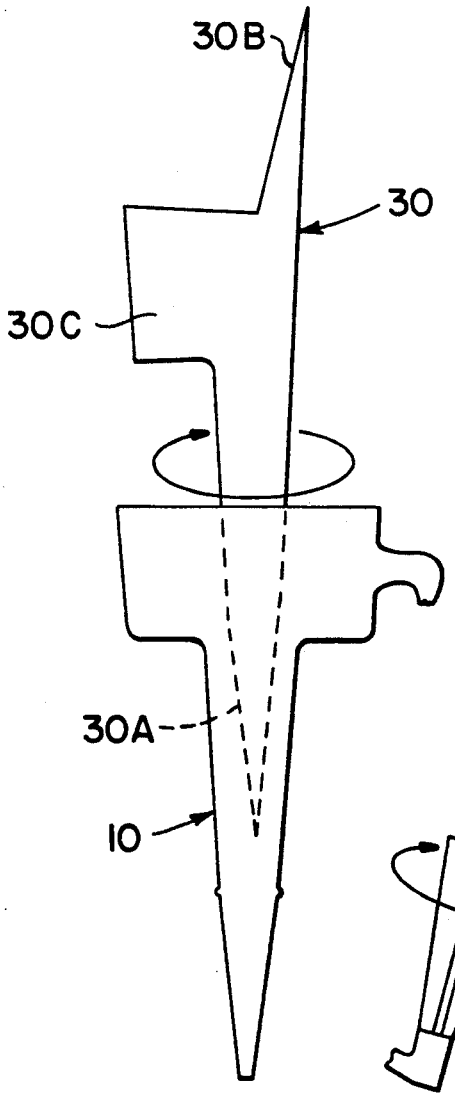
FIG. 7A and 7B are side elevational views illustrating a preferred tool for cleaning hardened composition out of the nozzle adaptor and the cap member.
Figure 7B:
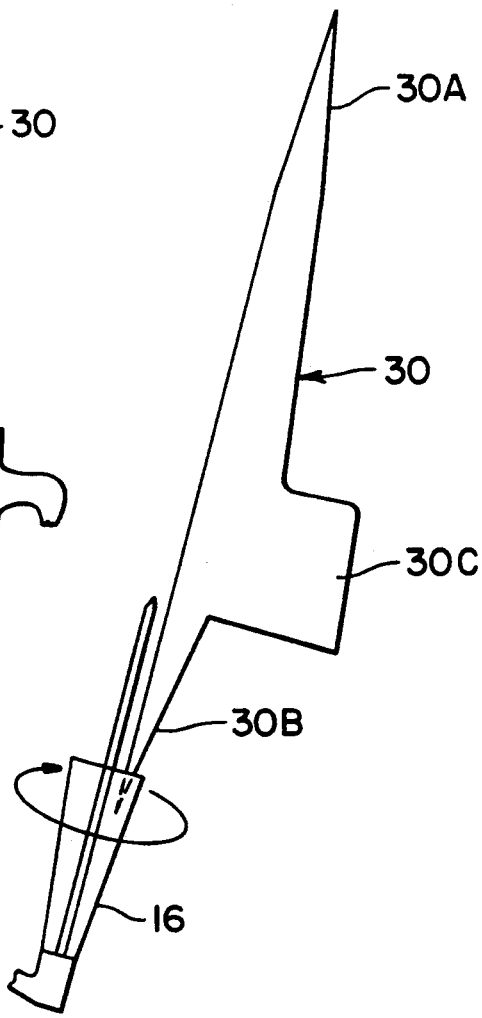

FIGS. 7A and 7B illustrate a preferred embodiment of a clean-out tool 30 for cleaning debris or hardened composition from the interior of the nozzle portion of the adaptor 10 and the cap 16. One end 30A of the clean-out tool is particularly adapted for cleaning out the nozzle portion, and the opposite end 30B is particularly adapted for cleaning out the cap 16. A gripping or handle portion 30C is located between the two ends, as illustrated.

Other variants are also possible without departing from the scope of this invention.

The nozzle adaptor may be made of plastic or rubber. The adaptor may be used on a caulking tube until it is empty. Then it may be taken off and used on another tube, as desired.

The opening at the upper end of the nozzle portion of the adaptor may have a diameter as small as 0.05 inch, as an example. If a larger opening is desired, the tip of the nozzle portion may be cut-off to leave a larger opening.

As another variation, an elongated flexible hose may be frictionally affixed to the outer end of the nozzle to serve as a conduit when applying composition from a caulking tube to cracks or other hard-to-reach areas.

What is claimed is:

1. A combination comprising a sealable nozzle adaptor and a caulking tube of the type including a tapered dispensing nozzle at the leading end of said tube; wherein said leading end of said tube includes a generally planar end face which is perpendicular to the longitudinal axis of said tube; said adaptor comprising:

(a) an elongated flexible nozzle portion having forward and rearward ends, wherein said forward end has a smaller diameter than said rearward end; said nozzle portion having a longitudinal passageway therethrough;

(b) a base member integral with said rearward end of said nozzle portion, wherein said base member includes a generally planar portion which is perpendicular to the longitudinal centerline of said nozzle portion; wherein said base member further includes a flexible skirt portion which extends rearwardly away from said planar portion for surrounding and frictionally engaging said leading end of said caulking tube;

(c) a cap member detachably attached to said forward end of said nozzle portion; said cap member including a first closed end and a second open end; said cap member including a cavity therein; and (d) an elongated pin member having first and second ends, wherein said first end is secured to said first end of said cap member; wherein said pin member extends through said cavity and beyond said open end of said cap and further extends into said rearward end of said nozzle portion;

wherein said nozzle adaptor is capable of sealing said nozzle of said caulking tube to prevent air from entering said nozzle.

2. A combination in accordance with claim 1, wherein said second end of said pin member extends into said leading end of said caulking tube.

3. A combination in accordance with claim 1, wherein said pin member is rigid and has a diameter in the range of about 0.05 to 0.15 inch.

4. A combination in accordance with claim 1, wherein said skirt portion extends rearwardly away from said planar portion at least 0.75 inch.

5. A combination in accordance with claim 1, further comprising a lever member for facilitating removal of said adaptor from said leading end of said tube, said lever member having a first end which is secured to said skirt portion and a said second end which projects outwardly away from said skirt portion; wherein when said second end of said lever is urged in the direction of said nozzle portion said skirt portion adjacent said lever is deflected away from said longitudinal centerline of said nozzle portion.

6. A combination in accordance with claim 1, further comprising an elongated flexible strip member connected between said cap member and said base member.

7. A combination in accordance with claim 6, wherein said strip member further includes an aperture therethrough for slidably receiving said pin member.

8. A combination comprising a sealable nozzle adaptor and a caulking tube of the type including a tapered dispensing nozzle at the leading end of said tube; wherein said leading end of said tube includes a generally planar end face which is perpendicular to the longitudinal axis of said tube; said adaptor comprising:

(a) an elongated flexible nozzle portion having forward and rearward ends, wherein the forward end has a smaller diameter than the rearward end; said nozzle portion having a longitudinal passageway therethrough;

(b) a base member integral with said rearward end of said nozzle portion, said base member including (1) a generally planar portion which is perpendicular to the longitudinal centerline of said nozzle portion; and (2) a skirt portion extending rearwardly away from said planar portion at least 0.75 inch for surrounding and slidably frictionally engaging said leading end of said caulking tube;

(c) a cap member detachably attached to said forward end of said nozzle portion; said cap member including a first closed end and a second open end; said cap member including a cavity therein; and (d) an elongated pin member having first and second ends, wherein said first end is secured to said first end of said cap member; wherein said pin member extends through said cavity and into said rearward end of said nozzle portion; wherein said second end of said pin member extends into said leading end of said caulking tube; wherein said nozzle adaptor is capable of sealing said nozzle of said caulking tube to prevent air from entering said nozzle.

9. A combination in accordance with claim 8, wherein said pin member is rigid and has a diameter in the range of about 0.05 to 0.15 inch.

10. A combination in accordance with claim 8, wherein said skirt portion includes at least one annular rib for engaging the outer surface of said caulking tube.

11. A combination in accordance with claim 8, wherein said open end of said cap member further includes an annular rib for engaging said nozzle portion.

12. A combination in accordance with claim 8, further comprising a lever member for facilitating removal of said adaptor from said leading end of said tube, said lever member having a first end which is secured to said skirt portion and a said second end which projects outwardly away from said skirt portion; wherein when said second end of said lever is urged in the direction of said nozzle portion said skirt portion adjacent said lever is deflected away from said longitudinal centerline of said nozzle portion.

13. A combination in accordance with claim 8, further comprising an elongated flexible strip member connected between said cap member and said base member.

14. A combination in accordance with claim 13, wherein said strip member further includes an aperture therethrough for slidably receiving said pin member.

15. A combination comprising a sealable nozzle adaptor and a caulking tube of the type including a tapered dispensing nozzle at the leading end of said tube; wherein said leading end of said tube includes a generally planar end face which is perpendicular to the longitudinal axis of said tube; said adaptor comprising:

(a) an elongated flexible nozzle portion having forward and rearward ends, wherein the forward end has a smaller diameter than the rearward end; said nozzle portion having a longitudinal passageway therethrough;

(b) a base member integral with said rearward end of said nozzle portion, said base member including (1) a generally planar portion which is perpendicular to the longitudinal centerline of said nozzle portion; and (2) a skirt portion extending rearwardly away from said planar portion at least 0.75 inch for surrounding and slidably frictionally engaging said leading end of the caulking tube; and wherein said base member further includes a lever member for facilitating removal of said adaptor from said leading end of said tube, said lever member having a first end which is secured to said skirt portion and a said second end which projects outwardly away from said skirt portion; wherein when said second end of said lever is urged in the direction of said nozzle portion said skirt portion adjacent said lever is deflected away from said longitudinal centerline of said nozzle portion, (c) a cap member detachably attached to said forward end of said nozzle portion; said cap member including a first closed end and a second open end; said cap member including a cavity therein; and (d) an elongated pin member having first and second ends, wherein said first end is secured to said first end of said cap member; wherein said pin member extends through said cavity and into said rearward end of said nozzle portion;

(e) an elongated flexible strip member connected between said cap member and said base member;

wherein said nozzle adaptor is capable of sealing said nozzle of said caulking tube to prevent air from entering said nozzle.

16. A combination in accordance with claim 15, wherein said strip member further includes an aperture therethrough for slidably receiving said pin member.

* * * * *